US012247369B2

(12) United States Patent
Legault

(10) Patent No.: US 12,247,369 B2
(45) Date of Patent: Mar. 11, 2025

(54) WICK DRAIN SHOE SYSTEMS AND METHODS

(71) Applicant: American Piledriving Equipment, Inc., Kent, WA (US)

(72) Inventor: Eric C. Legault, Kirkland Lake (CA)

(73) Assignee: American Piledriving Equipment, Inc., Kent, WA (US)

( * ) Notice: Subject to any disclaimer, the term of this patent is extended or adjusted under 35 U.S.C. 154(b) by 0 days.

(21) Appl. No.: 17/382,202

(22) Filed: Jul. 21, 2021

(65) Prior Publication Data

US 2022/0025602 A1 Jan. 27, 2022

Related U.S. Application Data

(60) Provisional application No. 63/056,437, filed on Jul. 24, 2020.

(51) Int. Cl.
*E02D 3/10* (2006.01)
*E02D 11/00* (2006.01)

(52) U.S. Cl.
CPC ..... *E02D 3/103* (2013.01); *E02D 11/00* (2013.01)

(58) Field of Classification Search
CPC . E02D 3/103; E02D 3/10; E02B 11/00; E02B 11/005
USPC ..... 405/50
See application file for complete search history.

(56) References Cited

U.S. PATENT DOCUMENTS

2022/0025602 A1 1/2022 Legault

FOREIGN PATENT DOCUMENTS

| | | | |
|---|---|---|---|
| JP | 6605856 | * | 6/2015 |
| KR | 200402916 | Y1 | 12/2005 |
| KR | 200412309 | * | 3/2006 |

OTHER PUBLICATIONS

Korean document 200402916 (Year: 2005).*
KR 200412309 (Year: 2006).*
Machine Translation of Korean document 200412309 (Year: 2006).*

* cited by examiner

*Primary Examiner* — Sunil Singh
(74) *Attorney, Agent, or Firm* — Michael R. Schacht; Schacht Law Office, Inc.

(57) ABSTRACT

A wick drain shoe is configured to be connected to a free end of a length of wick drain material and driven by a mandrel of a wick drain insertion system. The wick drain shoe comprises a base portion and an extension portion secured to the base portion to define first and second shoe openings, an anchor portion, and a bearing portion. The wick drain material is connected to the wick drain shoe by inserting the free end through the first and second shoe openings such that the anchor portion and bearing portion engage the wick drain material when the wick drain material is under tension. The base portion is sized and dimensioned to engage the mandrel such that displacement of the mandrel in a first direction causes displacement of the wick drain shoe in the first direction.

7 Claims, 16 Drawing Sheets

WICK DRAIN SHOE SYSTEMS AND METHODS

RELATED APPLICATIONS

This application, U.S. patent application Ser. No. 17/382,202 filed Jul. 21, 2021, claims benefit of U.S. Provisional Application Ser. No. 63/056,437 filed Jul. 24, 2020, the contents of which are incorporated herein by reference.

TECHNICAL FIELD

The present invention relates to methods and apparatus for inserting into the earth and extracting from the earth elongate members and, more particularly, to apparatus and methods for inserting wick drain material into the earth.

BACKGROUND

For certain construction projects, elongate members such as piles, anchor members, caissons, and mandrels for inserting wick drain material must be placed into and in some cases withdrawn from the earth. It is well-known that, in many cases, such rigid members may be driven into and withdrawn from the earth without prior excavation. The present invention is particularly advantageous when employed to insert a mandrel carrying wick drain material into the earth, and that application will be described in detail herein. Wick drain material is flexible and thus cannot be directly driven into the earth. Instead, it is normally arranged at least partly within a rigid mandrel that is driven into the earth. Once the mandrel and wick drain material have been driven into the earth, the mandrel alone is removed from the earth, leaving the wick drain material in place. The wick drain material that is left in place wicks moisture in its vicinity to the surface to stabilize the ground at that point.

To allow the mandrel to carry the wick drain material into the earth, the wick drain material is secured to a wick drain shoe, and the wick drain shoe is supported by the lower end of the mandrel such that the driving the mandrel into the earth also drives the wick drain shoe, and the end of the wick drain material secured thereto, into the earth. When the mandrel is removed, the wick drain shoe and at least a portion of the wick drain material are left in the ground.

The need exists for improved wick drain shoes for inserting wick drain material into the ground.

SUMMARY

The present invention may be embodied as a wick drain shoe configured to be connected to a free end of a length of wick drain material and driven by a mandrel of a wick drain insertion system. The wick drain shoe comprises a base portion and an extension portion secured to the base portion to define first and second shoe openings, an anchor portion, and a bearing portion. The wick drain material is connected to the wick drain shoe by inserting the free end through the first and second shoe openings such that the anchor portion and bearing portion engage the wick drain material when the wick drain material is under tension. The base portion is sized and dimensioned to engage the mandrel such that displacement of the mandrel in a first direction causes displacement of the wick drain shoe in the first direction.

The present invention may also be embodied as a method of driving a free end of a length of wick drain material into the earth using a mandrel of a wick drain insertion system, the method providing a base portion and providing an extension portion. The method may also comprise securing the extension portion to the base portion to define first and second shoe openings, an anchor portion, and a bearing portion. The method may also comprise inserting the free end through the first and second shoe openings such that the anchor portion and bearing portion engage the wick drain material when the wick drain material is under tension to connect the wick drain material to the wick drain shoe. The method further comprises arranging the mandrel to engage the base portion and displacing the mandrel in a first direction to displace the wick drain shoe in the first direction.

DETAILED DESCRIPTION

The present invention may be embodied in a number of different forms, and several examples of the present invention will be described in detail below.

I. First Example Wick Drain Shoe

Figure 1:
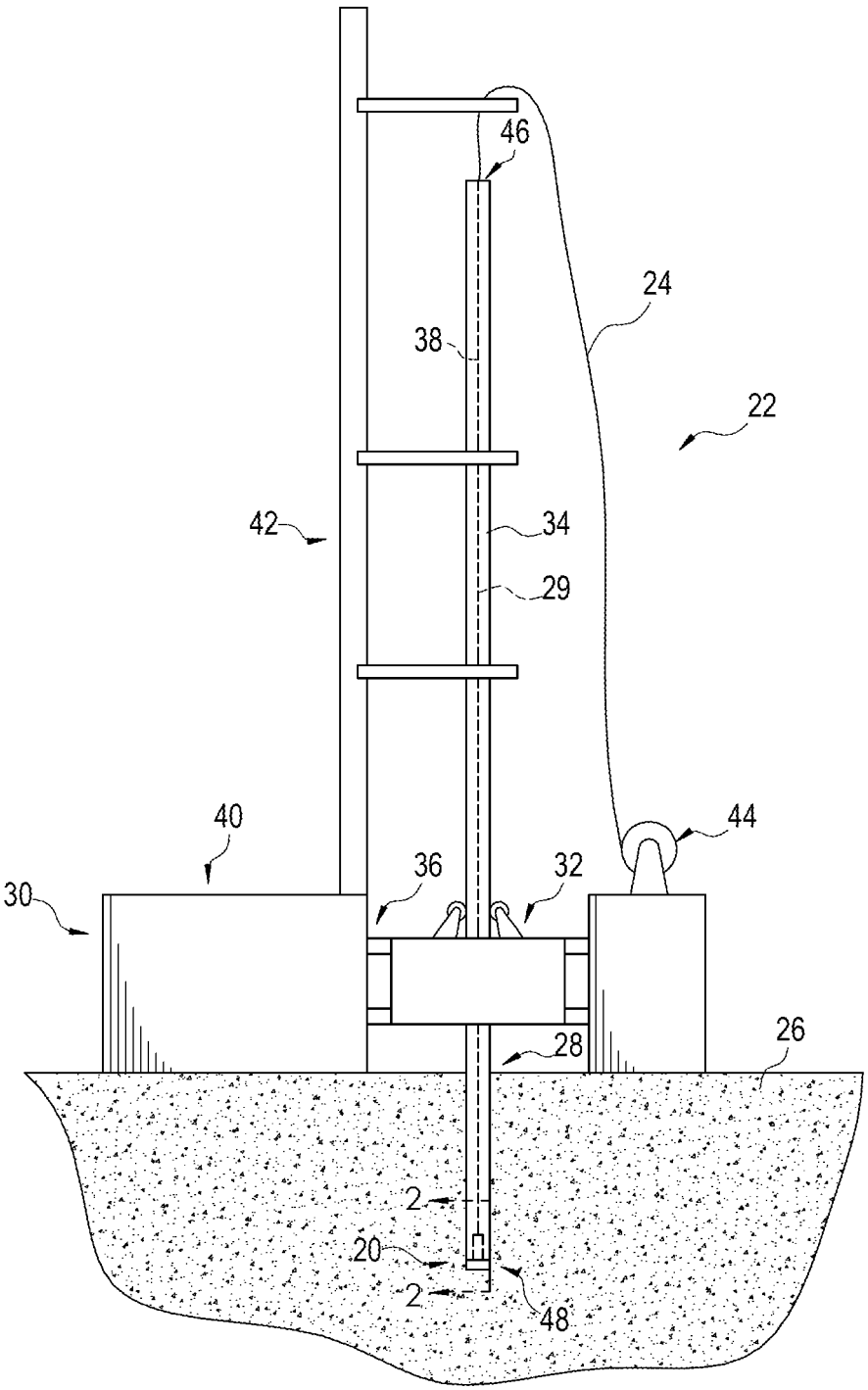
FIG. 1 is a somewhat schematic side elevation view of an example wick drain insertion system including a first example wick drain shoe of the present invention.

Referring initially to FIG. 1 of the drawing, depicted therein is a first example wick drain shoe 20 used with a wick drain insertion system 22 to insert wick drain material 24 into the ground 26 at a desired location 28. The example wick drain insertion system 22 is or may be conventional and comprises a support system 30, a drive system 32, a mandrel 34, and a suspension system 36. The example mandrel defines a mandrel cavity 38. The example support system 30 comprises a support base 40 and a support mast 42. In the example wick drain insertion system 22, at least a portion of the wick drain material 24 is supported on a reel 44 mounted on the support base 40. The wick drain material 24 extends from the reel 44, into the mandrel cavity 38 through a mandrel upper end opening 46, and through the mandrel cavity 38 to the first example wick drain shoe 20 at a mandrel lower end opening 48. The example drive system 32 is supported by the example support base 40 such that the drive system 32 is arranged above the desired location 28. The example drive system 32 is configured to drive the mandrel 34 into the ground 26 at the desired location 28. The example suspension system 36 may be configured to support the drive system 32 relative to the support system 30.

Figure 2:
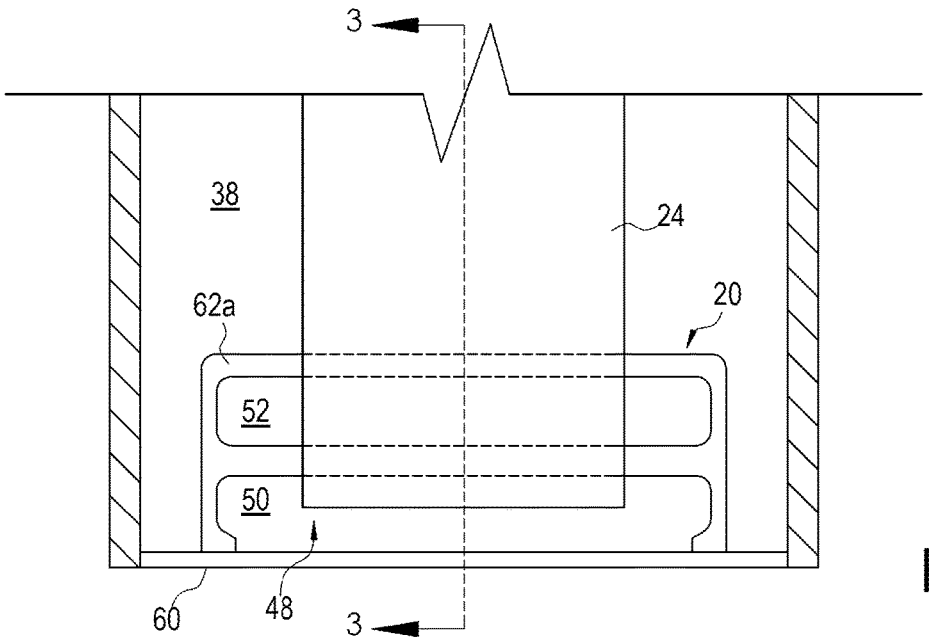
FIG. 2 is a front elevation view section view taken along lines 2-2 in FIG. 1 illustrating wick drain material secured to the first example wick drain shoe.
Figure 3:
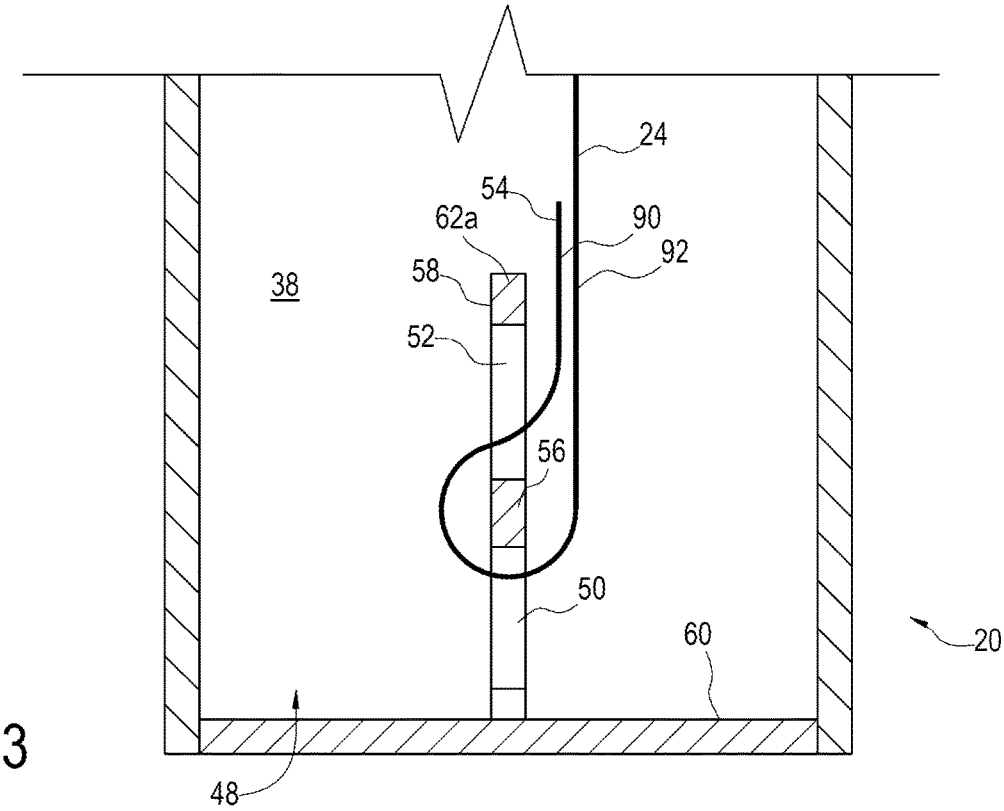
FIG. 3 is a section view taken along lines 3-3 in FIG. 2.
Figure 4:
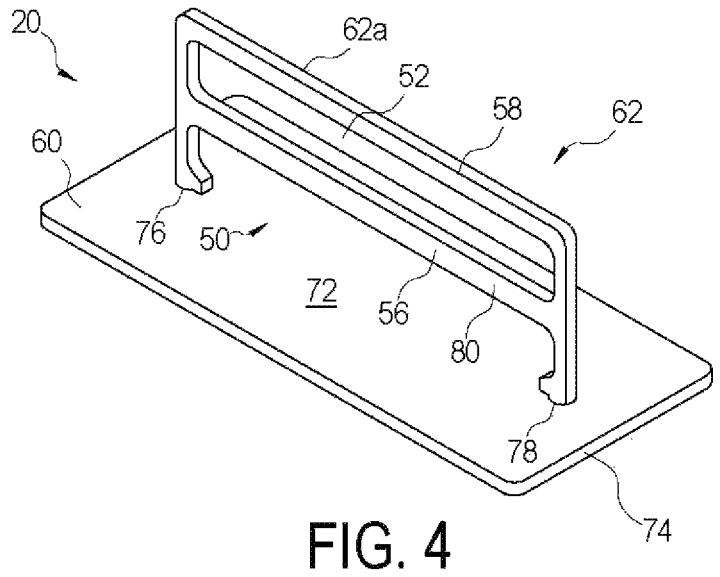
FIG. 4 is a perspective view of the first example wick drain shoe.
Figure 5:
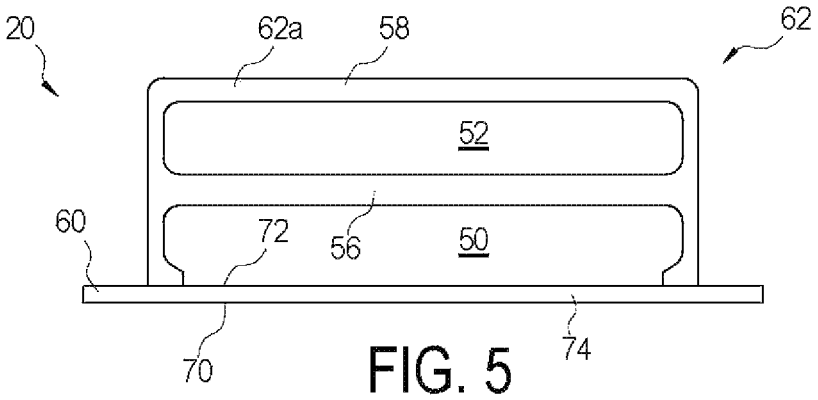
FIG. 5 is a front elevation view of the first example wick drain shoe.
Figure 6:
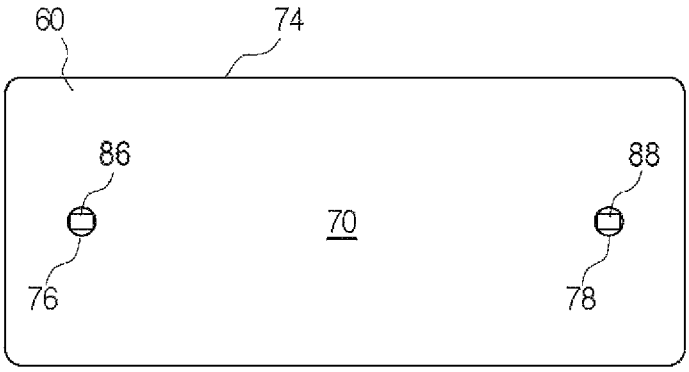
FIG. 6 is a bottom plan view of the first example wick drain shoe.
Figure 7:
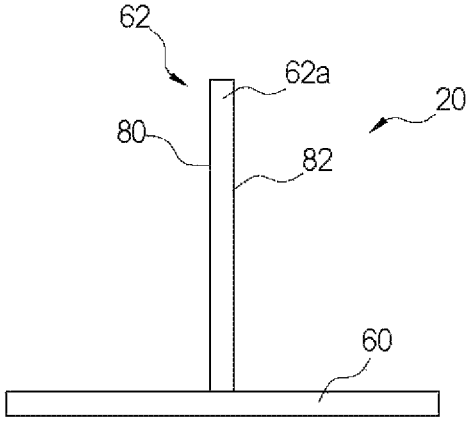
FIG. 7 is a side elevation view of the first example wick drain shoe.
Figure 8:
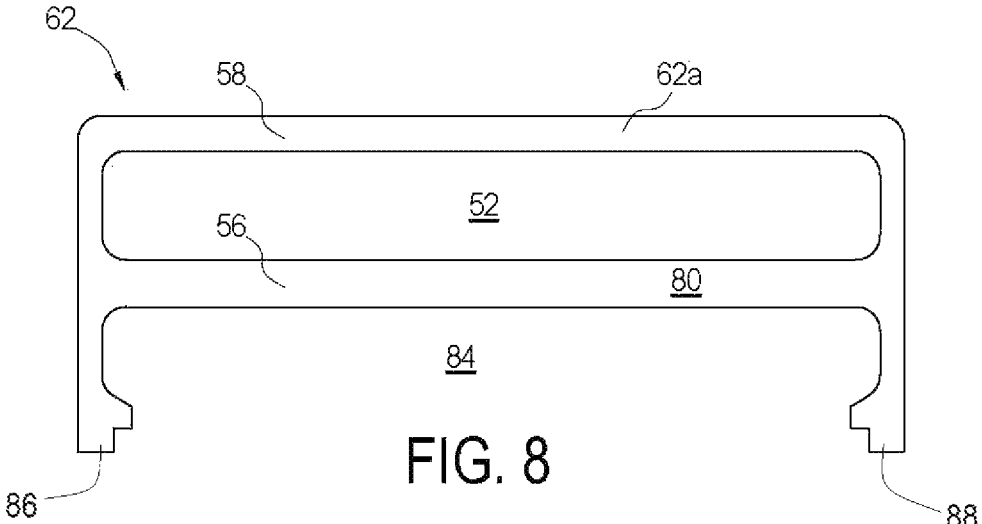
FIG. 8 is a front elevation view of a wick drain engaging portion of the first example wick drain shoe.
Figure 9:
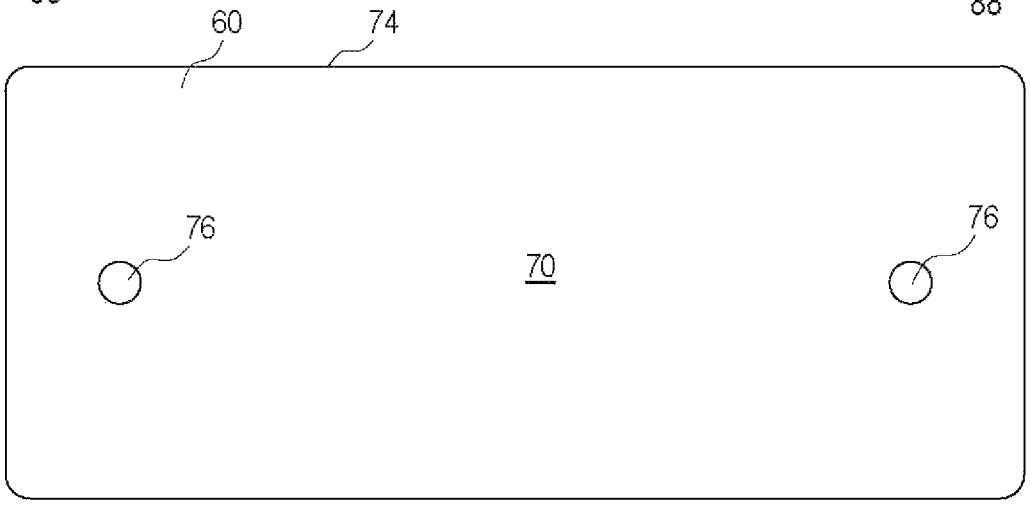
FIG. 9 is a bottom plan view of a ground engaging portion of the first example wick drain shoe.

FIGS. 2 and 3 illustrate that the example wick drain shoe 20 defines first and second shoe openings 50 and 52 and that a free end 54 of the wick drain material 24 is passed through the first and second openings 50 and 52 to secure to the free end 54 of the wick drain material 24 relative to anchor portion 56 of the example wick drain shoe 20. Further, tension on the wick drain material 24 causes the wick drain material 24 to be clamped between itself and a bearing portion 58 of the first example wick drain shoe 20. FIGS. 1 and 2 further illustrate that downward displacement of the example mandrel 34 drives the example wick drain shoe 20, and the free end 54 of the of the wick drain material 24 secured thereto, into the ground 26 at the desired location 28. After the free end 54 of the wick drain material 24 has been driven to a desired depth, raising of the mandrel 34 leaves the example wick drain shoe 20 and free end 54 of the wick drain material 24 secured to the example wick drain shoe 20 within the ground 28 at the desired depth and at the desired location.

Given the foregoing understanding of the construction and operation of the present invention, the details of construction and use of the first example wick drain shoe 20 will now be described in further detail.

FIGS. 2-9 illustrate that the first example wick drain shoe 20 comprises a base portion 60 and an extension structure 62 defining an extension portion 62*a*. The example base portion 60 is a plate defining first and second base surfaces 70 and 72, a base perimeter edge 74, and first and second connection openings 76 and 78. The example extension portion 62*a* is a plate defining first and second extension surfaces 80 and 82, the second shoe opening 52, a buckle notch 84, a first connection projection 86, and a second connection projection 88. To connect the example extension portion 62*a* to the base portion 60, the first and second connection projections 86 and 88 are arranged at least partly within the first and second connection openings 76 and 78 and welded to surfaces of the base portion 60 defining the connection openings 76 and 78. At this point, the first shoe opening 50 is formed by the space defined by the buckle notch 84 and the second base surface 72.

Referring for a moment back to FIGS. 2 and 3, it can be seen that the free end 54 of the wick drain material 24 is passed through the first shoe opening 50 and then through the second shoe opening 52 such that the wick drain material 24 loops around the anchor portion 56 and such that at least a first portion 90 of the wick drain material 24 is between the bearing portion 58 and a second portion 92 of the wick drain material 24. Tension on the wick drain material 24 effectively clamps the first portion 90 of the wick drain material 24 between the second portion 92 of the wick drain material and the bearing portion 58. At that point, friction inhibits movement of the free end 54 relative to the first example wick drain shoe 20 and thus the free end 54 is carried with the first example wick drain shoe 20 when the example wick drain shoe 20 is displaced by the mandrel 34.

FIGS. 2 and 3 illustrate that the extension portion 62*a* of the first example wick drain shoe 20 extends into the mandrel cavity 38 through the mandrel lower opening 48. FIGS. 2 and 3 further illustrate that the base portion 60 of the first example wick drain shoe 20 and the mandrel 34 are configured such that, with the first example wick drain shoe 20 in a drive configuration relative to the mandrel 34, downward forces on the mandrel 34 are transmitted to the first example wick drain shoe 20 and the free end 54 of the wick drain material 24 connected thereto. These downward forces further place the wick drain material 24 in tension, thereby securing the free end 54 of the wick drain material 24 relative to the first example wick drain shoe 20 as describe above.

The first base surface 70 is configured to engage the soil at the desired location 28 to allow the first example wick drain shoe 20 to be driven into the ground 26 using the mandrel 34. Accordingly, the shape of the base perimeter edge 74 and of the mandrel 34 will be configured to match each other and to suit soil conditions at the desired location 28.

II. Second Example Wick Drain Shoe

Figure 10:
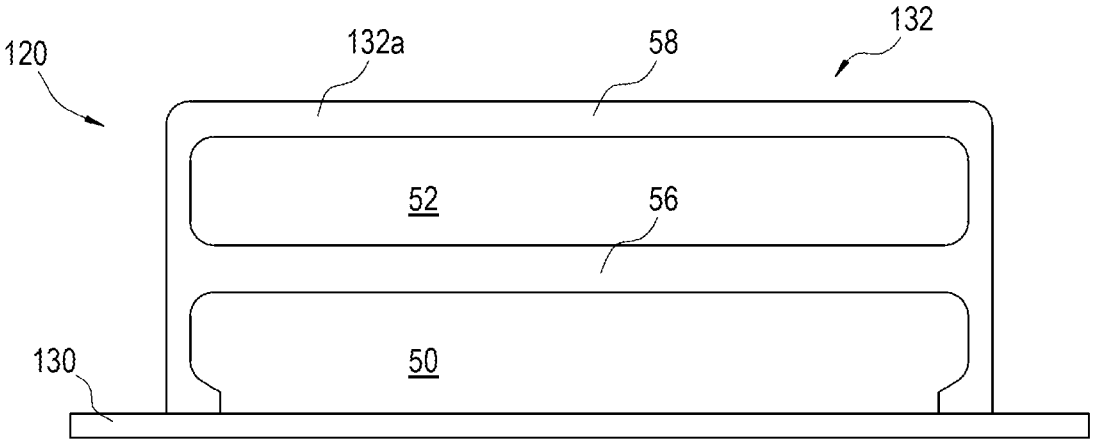
FIG. 10 is a front elevation view of a second example wick drain shoe of the present invention.
Figure 11:
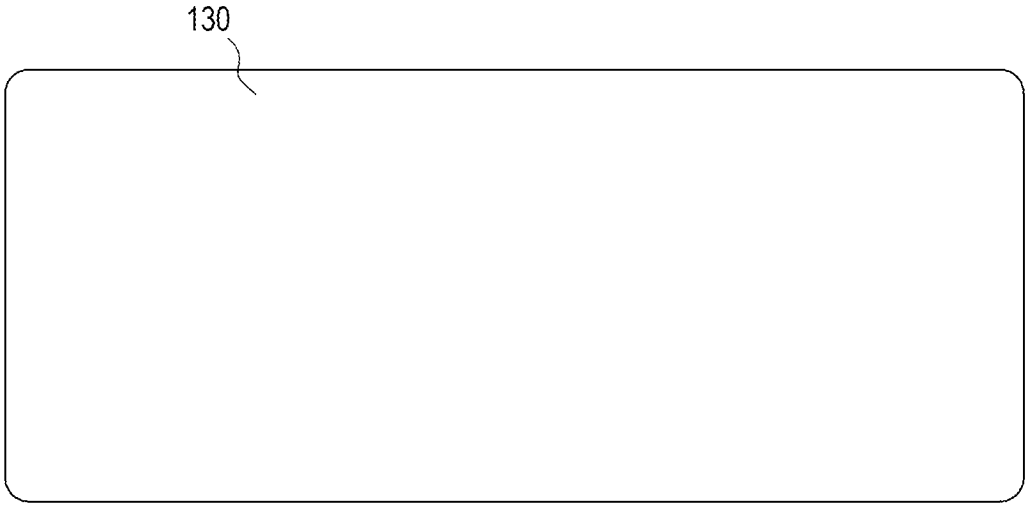
FIG. 11 is a bottom plan view of the second example wick drain shoe.

Referring now to FIGS. 10 and 11 of the drawing, depicted therein is a second example wick drain shoe 120 constructed in accordance with, and embodying, the principles of the present invention. The second example wick drain shoe 120 comprises a base portion 130 and an extension structure 132 comprising an extension portion 132*a*. The example extension portion 132*a* defines a second shoe opening 52, an anchor portion 56, and a bearing portion 58. The example extension portion 132*a* is integrally formed with the example base portion 130 by casting, machining, or the like, and a first shoe opening 50 is formed by a space formed by the anchor portion 56 of the extension portion 132*a* and the base portion 130.

The second example wick drain shoe 120 is connected to the wick drain material 24 and may be driven by the example wick drain insertion system 22 in the same manner as first example wick drain shoe 20.

III. Third Example Wick Drain Shoe

Figure 12:
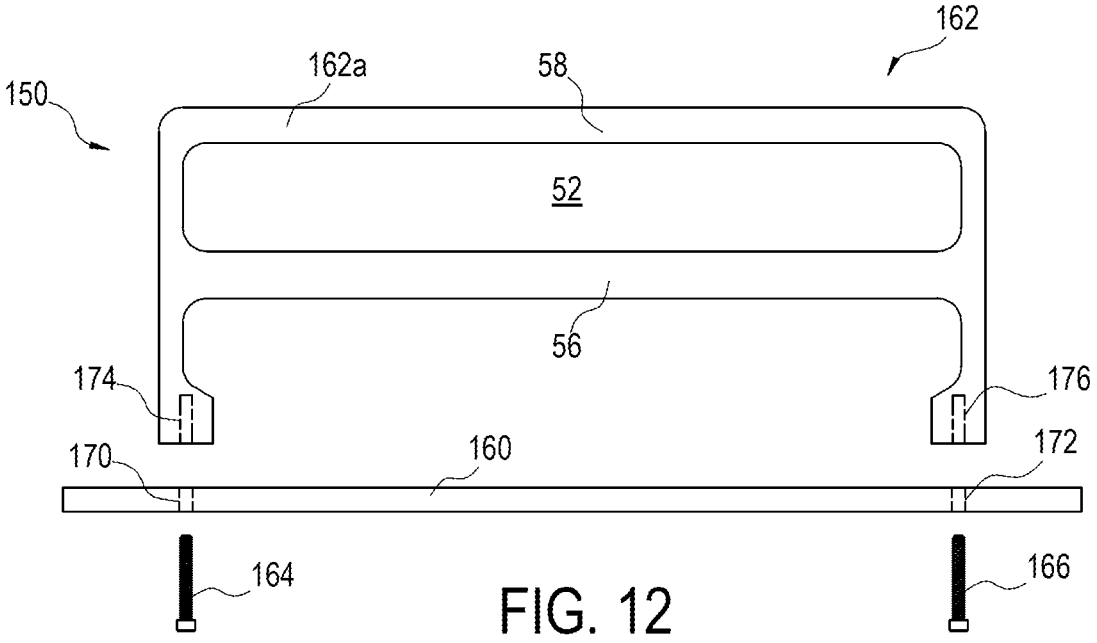
FIG. 12 is a front elevation exploded view of a third example wick drain shoe of the present invention.
Figure 13:
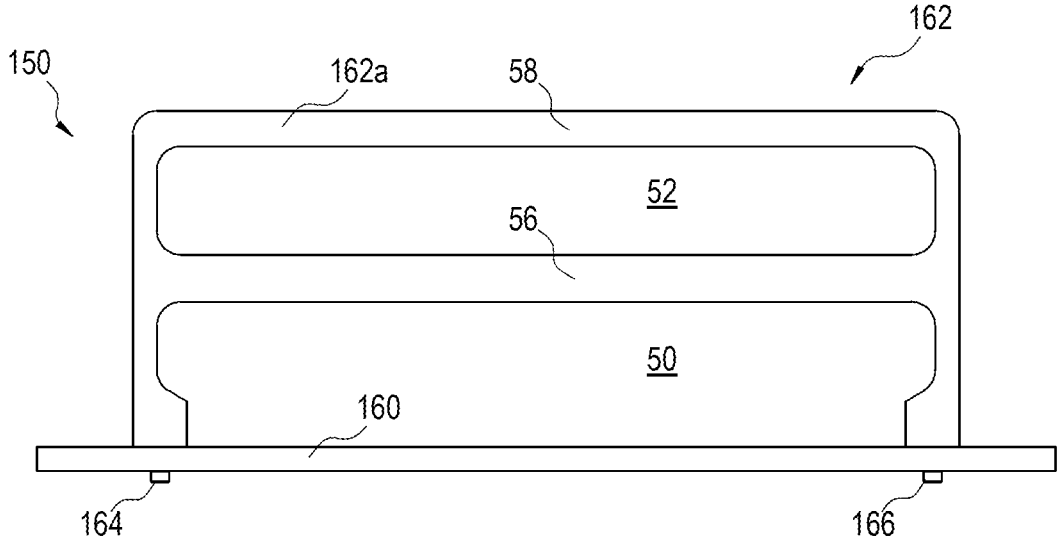
FIG. 13 is a front elevation assembled view of the third example wick drain shoe.
Figure 14:
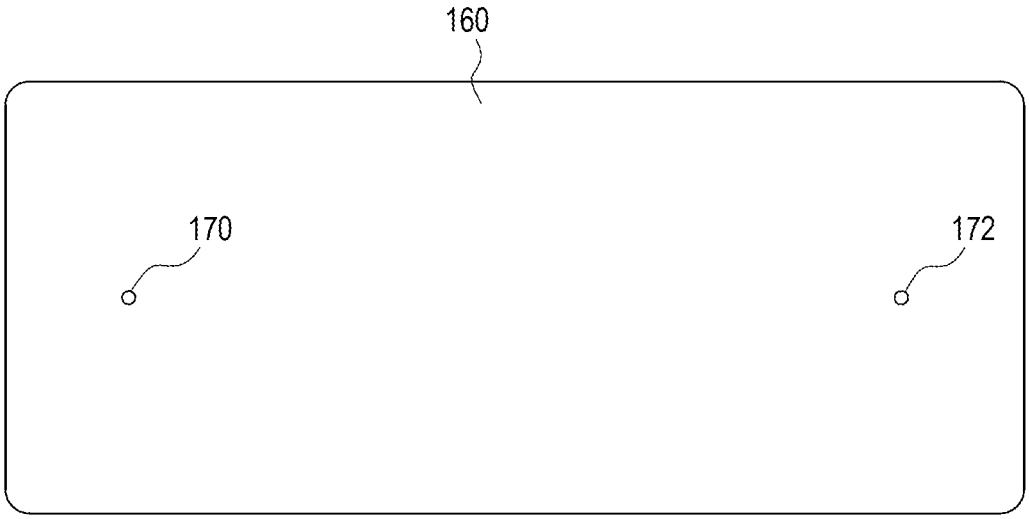
FIG. 14 is a bottom plan view of a ground engaging portion of the third example wick drain shoe.
Figure 15:
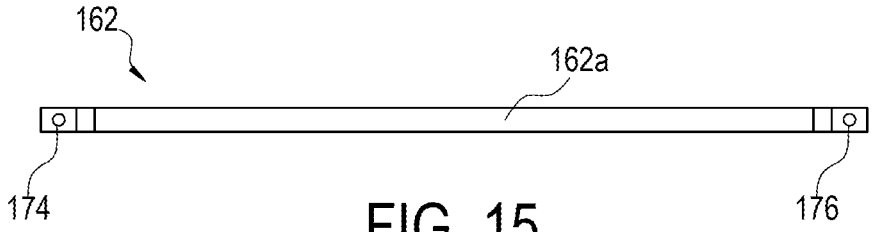
FIG. 15 is a bottom plan view of a wick drain engaging portion of the third example wick drain shoe.

Referring now to FIGS. 12-15 of the drawing, depicted therein is a third example wick drain shoe 150 constructed in accordance with, and embodying, the principles of the present invention. The third example wick drain shoe 150 comprises a base portion 160, an extension structure 162 comprising an extension portion 162*a*, and first and second connecting bolts 164 and 166. The example extension portion 162*a* defines a second shoe opening 52, the anchor portion 56, and the bearing portion 58. FIG. 14 illustrates that first and second connecting holes 170 and 172 are formed in the base portion 160, and FIG. 15 illustrates that first and second threaded bores 174 and 176 are formed in the extension portion 162*a*. The example extension portion 162*a* may be secured to the example base portion 160 as shown in FIGS. 12 and 13 by inserting the first and second connecting bolts 164 and 166 through the first and second connecting holes 170 and 172 and then threading the first and second connecting bolts 164 and 166 into the first and second threaded bores 174 and 176, respectively. So assembled, a first shoe opening 50 is formed by a space formed by the anchor portion 56 of the extension portion 162*a* and the base portion 160.

The third example wick drain shoe 150 is connected to the wick drain material 24 and may be driven by the example wick drain insertion system 22 in the same manner as first and second example wick drain shoes 20 and 120.

IV. Fourth Example Wick Drain Shoe

Figure 16:
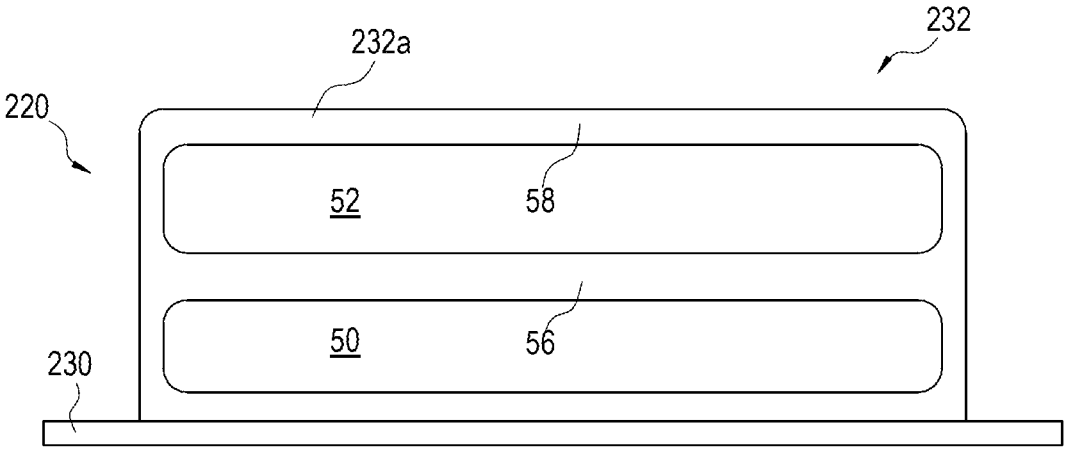
FIG. 16 is a front elevation view of a fourth example wick drain shoe of the present invention.
Figure 17:
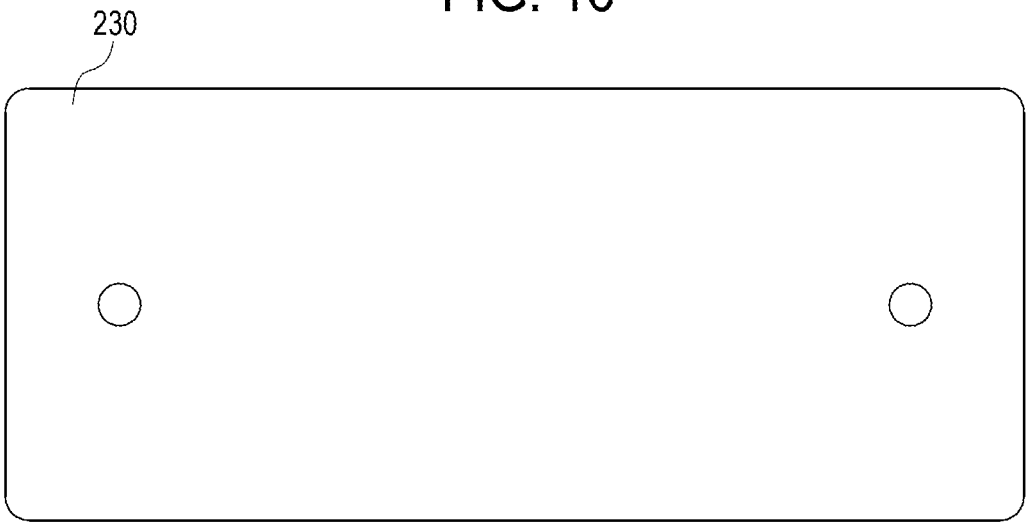
FIG. 17 is a bottom plan view of a ground engaging portion of the fourth example wick drain shoe.
Figure 18:
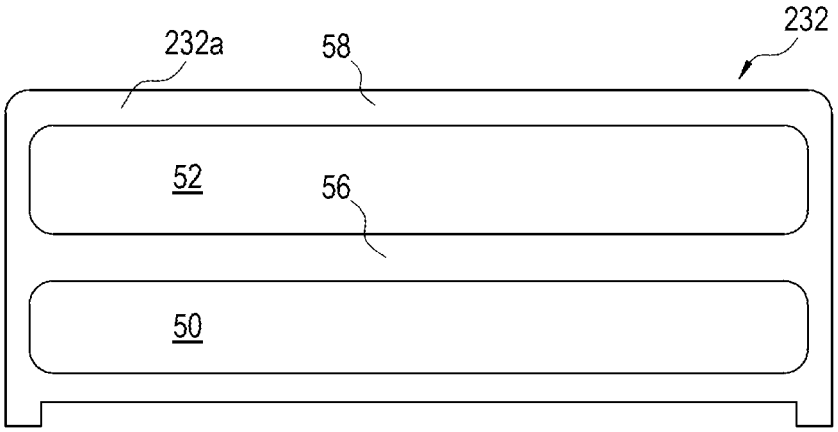
FIG. 18 is a front elevation view of a wick drain engaging portion of the fourth example wick drain shoe.
Figure 19:
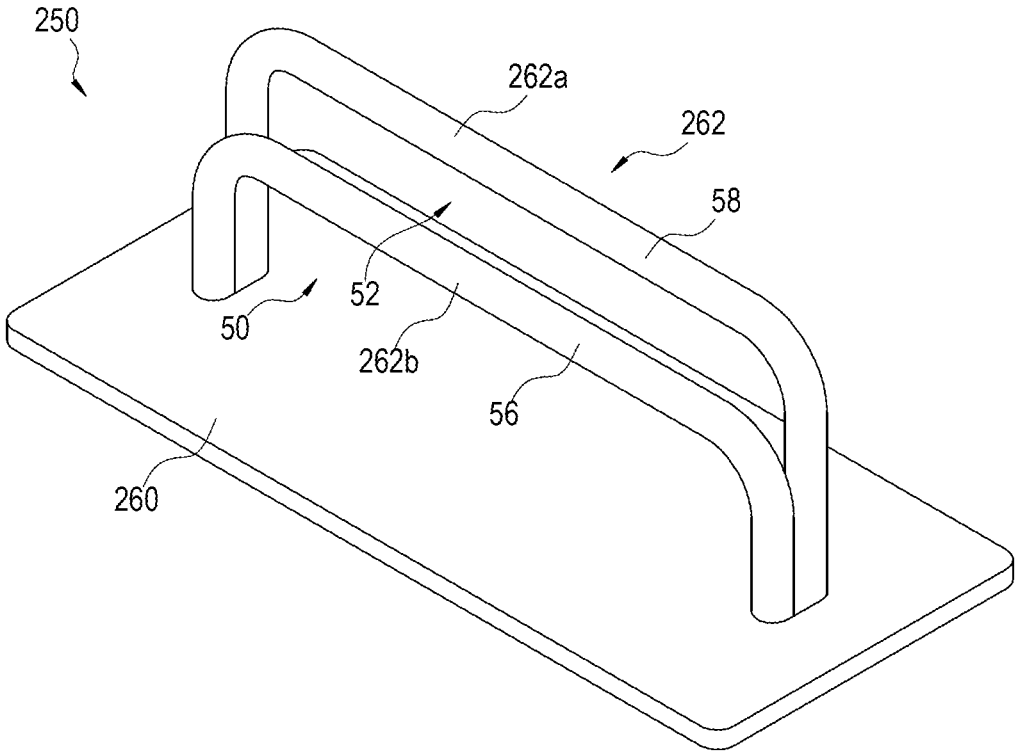
FIG. 19 is a perspective view of a fifth example wick drain shoe of the present invention.
Figure 20:
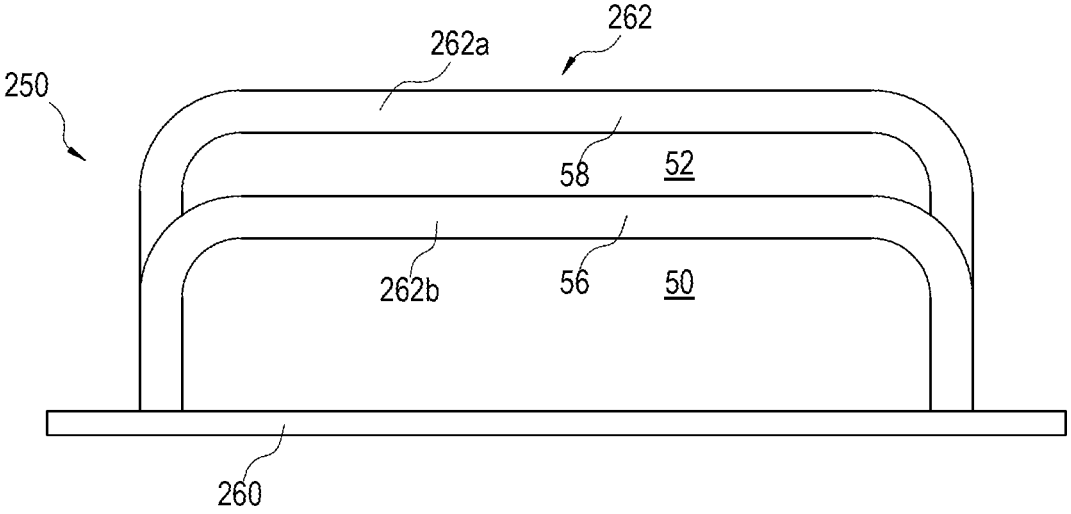
FIG. 20 is a front elevation view of the fifth example wick drain shoe.
Figure 21:
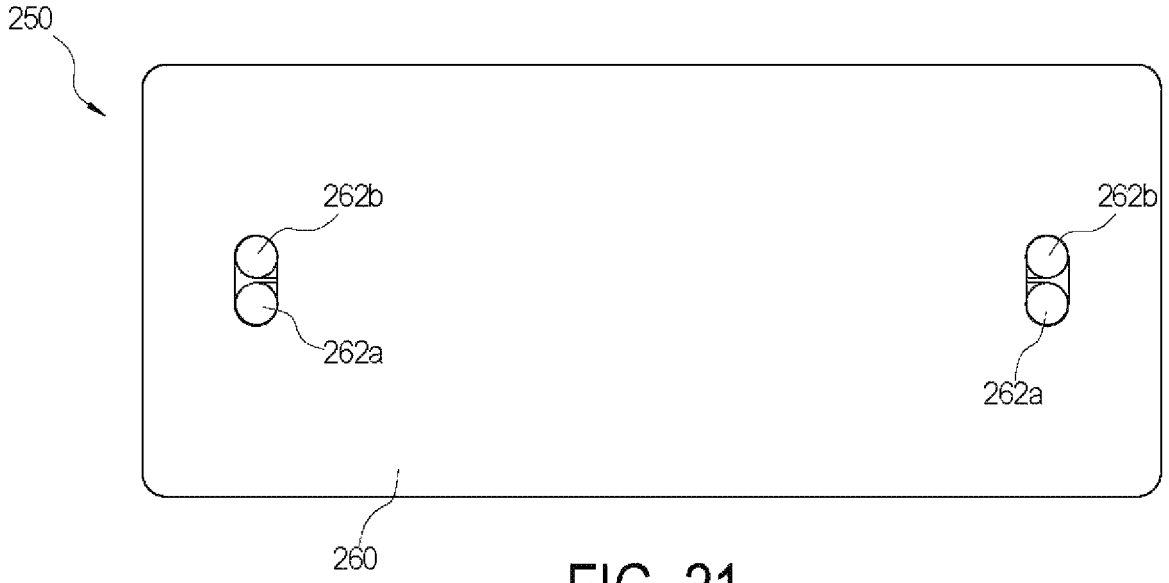
FIG. 21 is a bottom plan view of the fifth example wick drain shoe.
Figure 22:
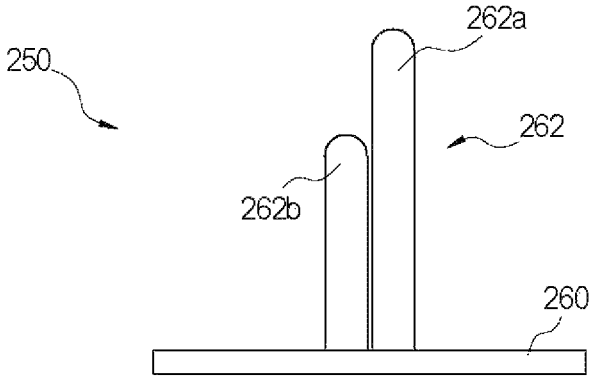
FIG. 22 is a side elevation view of the fifth example wick drain shoe.
Figure 23:
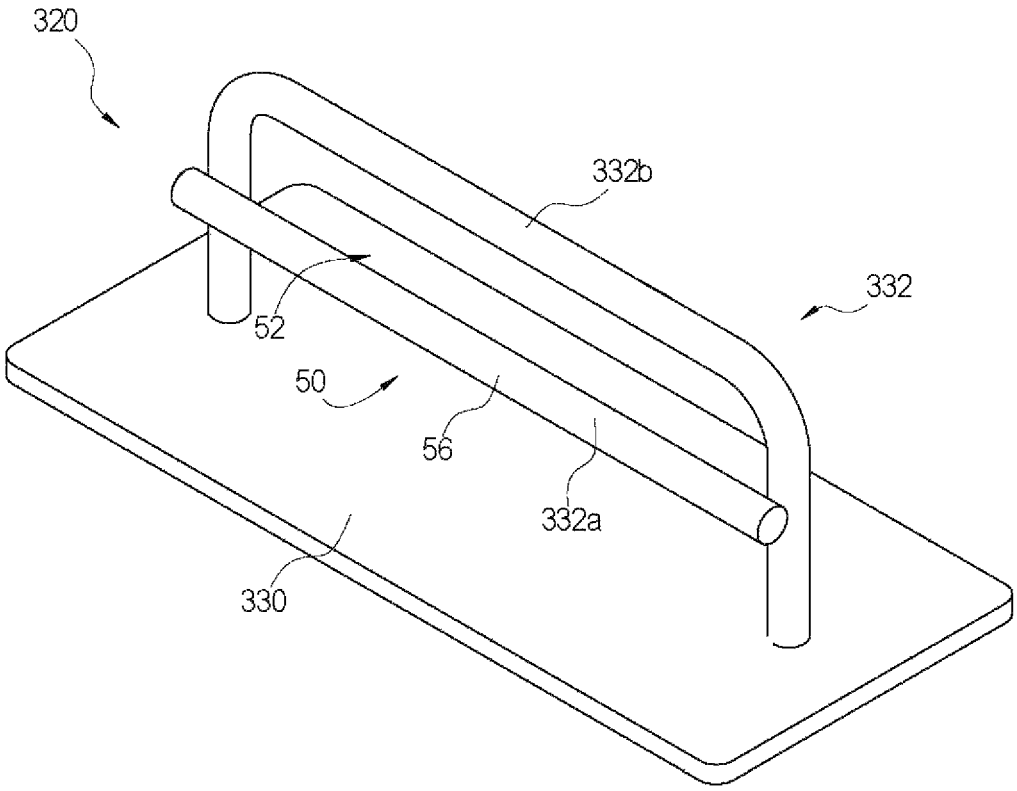
FIG. 23 is a perspective view of a sixth example wick drain shoe of the present invention.
Figure 24:
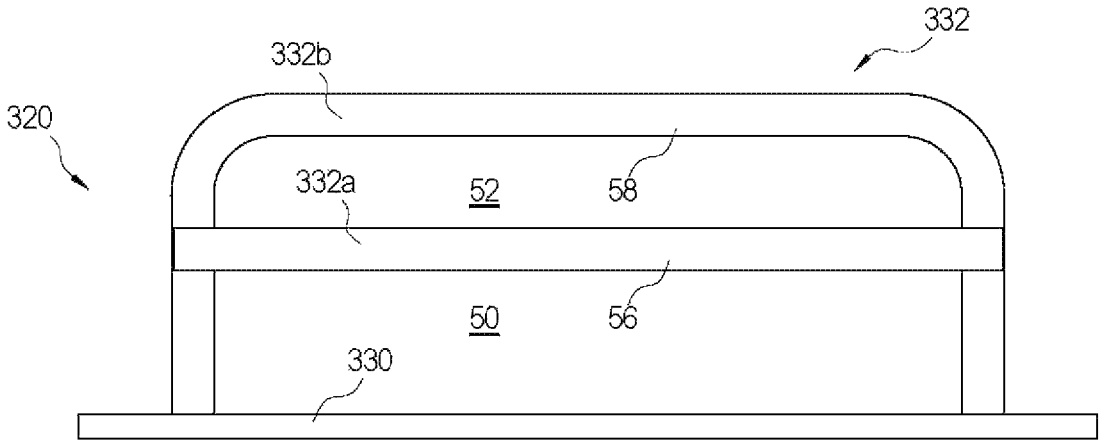
FIG. 24 is a front elevation view of the sixth example wick drain shoe.
Figure 25:
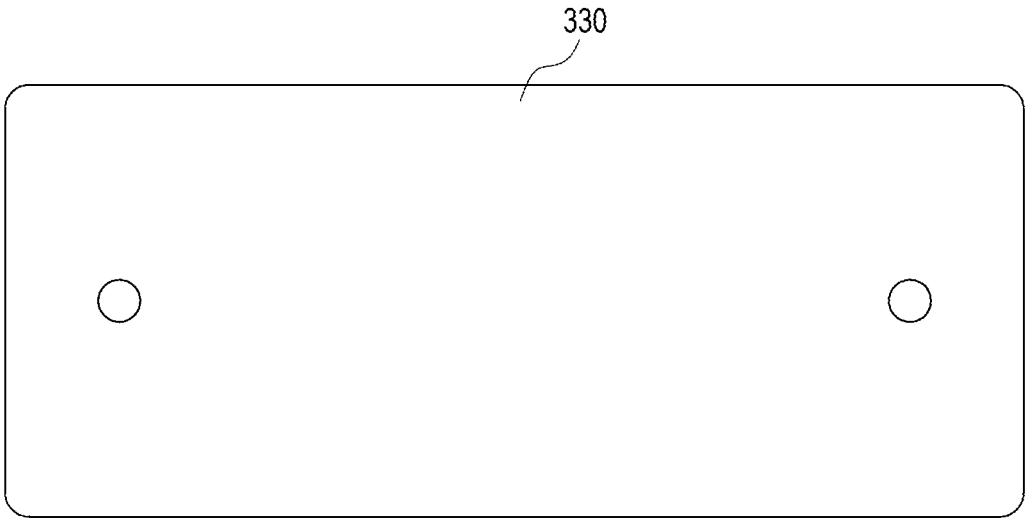
FIG. 25 is a bottom plan view of a ground engaging portion of the sixth example wick drain shoe.
Figure 26:
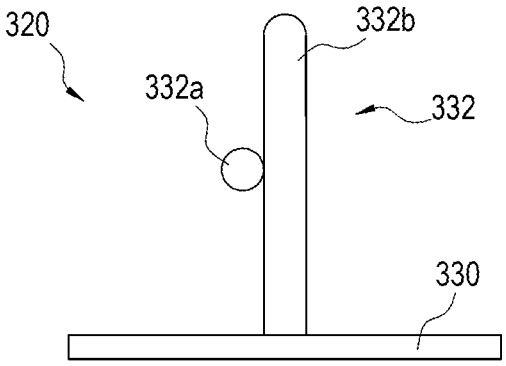
FIG. 26 is a side elevation view of the sixth example wick drain shoe.
Figure 27:
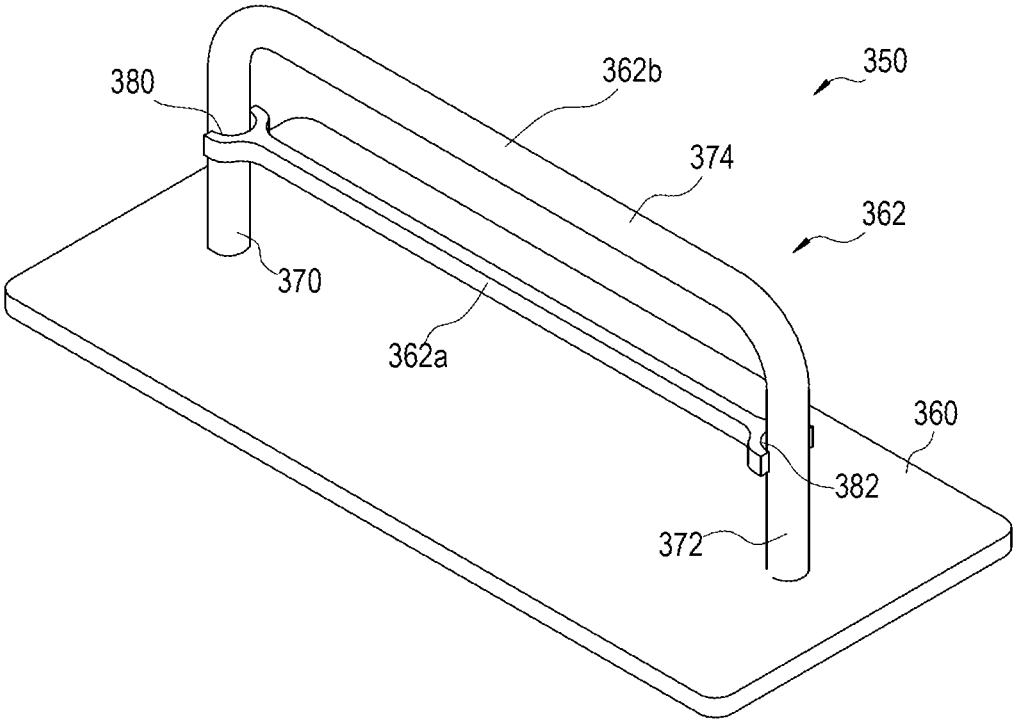
FIG. 27 is a perspective view of a seventh example wick drain shoe of the present invention.
Figure 28:
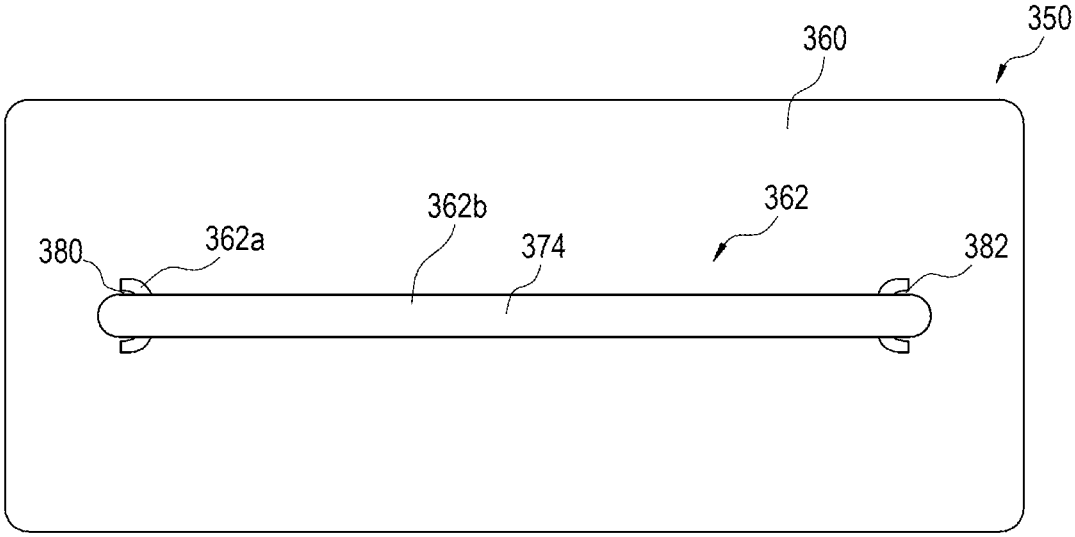
FIG. 28 is top plan view of the seventh example wick drain shoe.

Referring now to FIGS. 16-18 of the drawing, depicted therein is a fourth example wick drain shoe 220 constructed in accordance with, and embodying, the principles of the present invention. The fourth example wick drain shoe 220 comprises a base portion 230 and an extension structure 232 comprising an extension portion 232*a*. The example extension portion 232*a* defines a first shoe opening 50, the second shoe opening 52, an anchor portion 56, and a bearing portion 58. The example extension portion 232*a* may be secured to the example base portion 230 by welding as described above with reference to the first example wick drain shoe 20 or by connecting bolts as described above with reference to the third example drain shoe 150. The example extension portion 232*a* may be integrally formed with the example base portion 230 as described above with reference to the second example wick drain shoe 120.

The fourth example wick drain shoe 220 is connected to the wick drain material 24 and may be driven by the example wick drain insertion system 22 in the same manner as the example wick drain shoes 20, 120, and 150 described above.

V. Fifth Example Wick Drain Shoe

Referring now to FIGS. 19-22 of the drawing, depicted therein is a fifth example wick drain shoe 250 constructed in accordance with, and embodying, the principles of the present invention. The fifth example wick drain shoe 250 comprises a base portion 260 and an extension structure 262 comprising a first extension portion 262*a* and a second extension portion 262*b*. The example first and second extension portions 262*a* and 262*b* are rods, tubes, or bars bent in a generally U-shaped configuration, with the legs of the U forming the second extension portion 262*b* being longer than the legs of the U forming the first extension portion 262*a*. The example first and second extension portions 262*a* and 262*b* may be secured to the example base portion 260 by welding as generally described above with reference to the first example wick drain shoe 20 or by connecting bolts as described above with reference to the third example drain shoe 150. The example first and second extension portions 262*a* and 262*b* may be integrally formed with the example base portion 260 as described above with reference to the second example wick drain shoe 120.

A first shoe opening 50 is defined between the first extension portion 262*a* and the base portion 260. The example second extension portion 262*b* defines the bearing portion 58. The second shoe opening 52 is defined between the first and second extension portions 262*a* and 262*b*.

The fifth example wick drain shoe 250 is connected to the wick drain material 24 and may be driven by the example wick drain insertion system 22 in the same manner as the example wick drain shoes 20, 120, 150, and 220 described above.

VI. Sixth Example Wick Drain Shoe

Referring now to FIGS. 23-26 of the drawing, depicted therein is a sixth example wick drain shoe 320 constructed in accordance with, and embodying, the principles of the present invention. The sixth example wick drain shoe 320 comprises a base portion 330 and an extension structure 332 comprising a first extension portion 332*a* and a second extension portion 332*b*. The example first and second extension portions 332*a* and 332*b* are rods, tubes, or bars. The example second extension portion 332*b* is bent in a generally U-shaped configuration. The example first extension portion 332*a* is a straight bar integrally formed with or connected by welding of the like to the legs of the U formed by the example second extension portion 332*b*. The example second extension portion 332*b* may be secured to the example base portion 330 by welding as generally described above with reference to the first example wick drain shoe 20 or by connecting bolts as described above with reference to the third example drain shoe 150. The example first and second extension portions 332*a* and 332*b* may be integrally formed with the example base portion 330 as described above with reference to the second example wick drain shoe 120.

The example first extension portion 332*a* defines the anchor portion 56, and the first shoe opening 50 is defined between the first extension portion 332*a* and the base portion 330. The example second extension portion 332*b* defines the bearing portion 58. The second shoe opening 52 is defined between the first and second extension portions 332*a* and 332*b*.

The sixth example wick drain shoe 320 is connected to the wick drain material 24 and may be driven by the example wick drain insertion system 22 in the same manner as the example wick drain shoes 20, 120, 150, 220, and 250 described above.

VII. Seventh Example Wick Drain Shoe

Referring now to FIGS. 27-31 of the drawing, depicted therein is a seventh example wick drain shoe 350 constructed in accordance with, and embodying, the principles of the present invention. The seventh example wick drain shoe 350 comprises a base portion 360 and an extension structure 362 comprising a cross portion 362*a*, and an extension portion 362*b*. The example cross portion 362*a* is a plate, plate, rod, tube, or bar, and the example extension portion 362*b* is a plate, rod, tube, or bar that is formed in a generally U-shaped configuration to define first and second leg portions 370 and 372 and a closed end portion 374. The example extension portion 362*b* may be secured to the example base portion 360 by welding as generally described above with reference to the first example wick drain shoe 20 or by connecting bolts as described above with reference to the third example drain shoe 150. The example extension portion 362*b* may be integrally formed with the example base portion 360 as described above with reference to the second example wick drain shoe 120.

Figure 29:
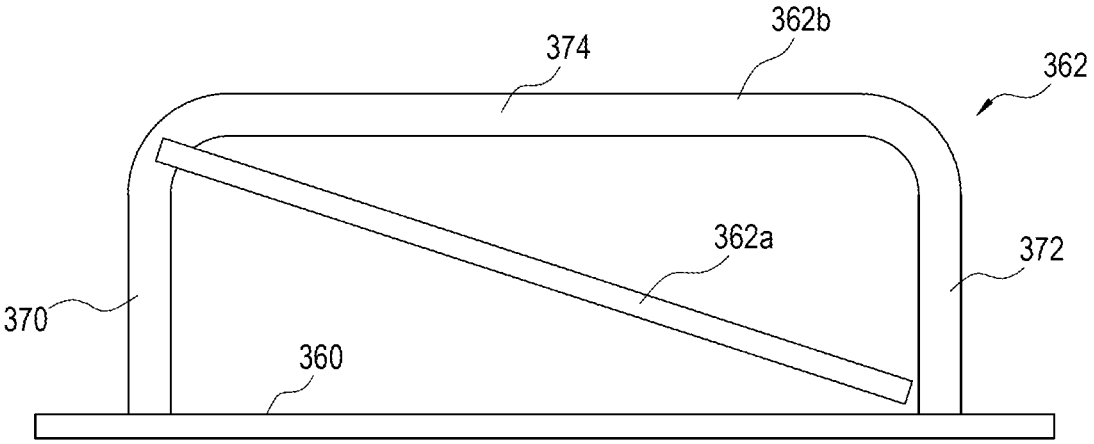
FIG. 29 is a front elevation plan view illustrating assembly of the seventh example wick drain shoe.
Figure 30:
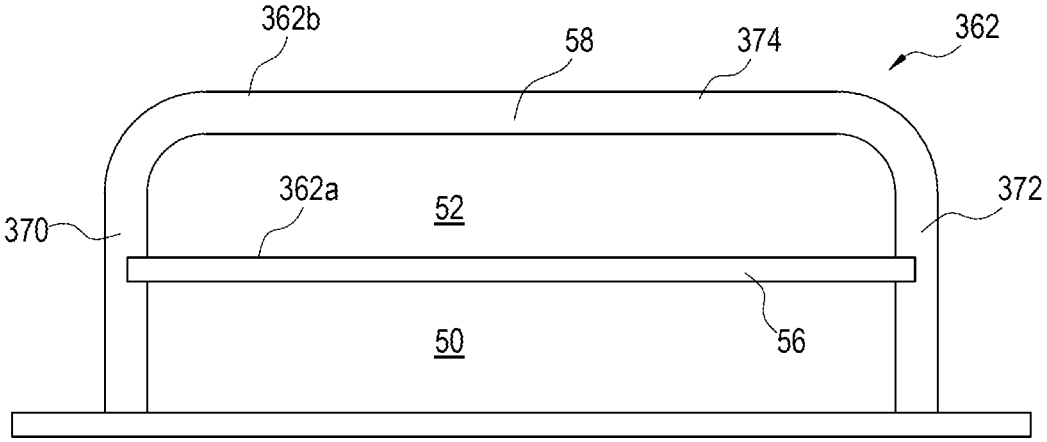
FIG. 30 is a front elevation plan view illustrating the seventh example wick drain shoe assembled for use.
Figure 31:
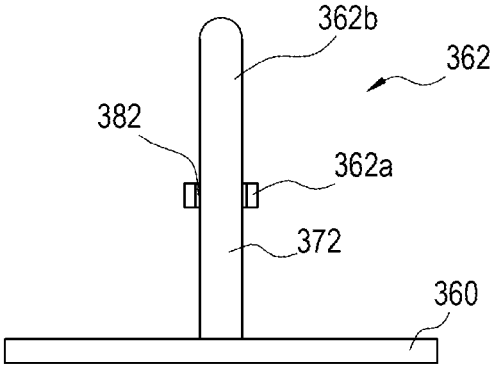
FIG. 31 is a side elevation plan view illustrating the seventh example wick drain shoe assembled for use.

The example cross portion 362*a* defines first and second end notches 380 and 382. More specifically, the example cross portion 362*a* is an elongate plate configured such that the first and second end notches 380 and 382 are integrally formed on each end the plate. In the example cross portion 362*a*, a shortest distance between portions of the cross portion 262*a* defining the first and second end notches 380 and 382 is less than a shortest distance between inner surfaces of the first and second leg portions 370 and 372 of the U defined by the extension portion 362*b*. However, at least portions of the cross portion 262*a* defining the first and second end notches 380 and 382 are spaced a distance greater than the shortest distance between inner surfaces of the first and second leg portions 370 and 372 of the U defined by the extension portion 362*b*. Accordingly, the cross portion 362*a* is sized and dimensioned to be arranged relative to the extension portion 362*b* in an assembly configuration as shown in FIG. 29 in which the first and second end notches 380 and 382 can receive opposing portions of the first and second leg portions 370 and 372 defined by the U-shaped extension portion 362*b* and in an assembled configuration as shown in FIGS. 27, 28, 30, and 31 in which the first and second end notches 380 and 382 engage the first and second leg portions 370 and 372 defined by the U-shaped extension portion 362*b*. When arranged in the assembled configuration, the cross portion 362*a* can move up and down along the extension portion 362*b* relative to the base portion 360 but, the first and second end notches 380 and 382 engage the first and second leg portions 370 and 372 to inhibit movement forward or back relative to the extension portion 362*b*.

The example cross portion 362*a* defines the anchor portion 56, and the first shoe opening 50 is defined between the cross portion 362*a* and the base portion 360. The example extension portion 362*b* defines the bearing portion 58. The second shoe opening 52 is defined between the cross portion 362*a* and the extension portion 362*b*.

The seventh example wick drain shoe 350 is connected to the wick drain material 24 and may be driven by the example wick drain insertion system 22 in generally the same manner as the example wick drain shoes 20, 120, 150, 220, 250, and 320 described above. However, when the wick drain material 24 is under tension, the wick drain material 24 will pull the cross portion 362*a* up towards the closed end portion 374 of the extension portion 362*b* to enhance clamping or pinching forces on at least the portion of the wick drain material 24 arranged between the cross portion 362*a* and the extension portion 362*b*.

VIII. Eighth Example Wick Drain Shoe

Figure 32:
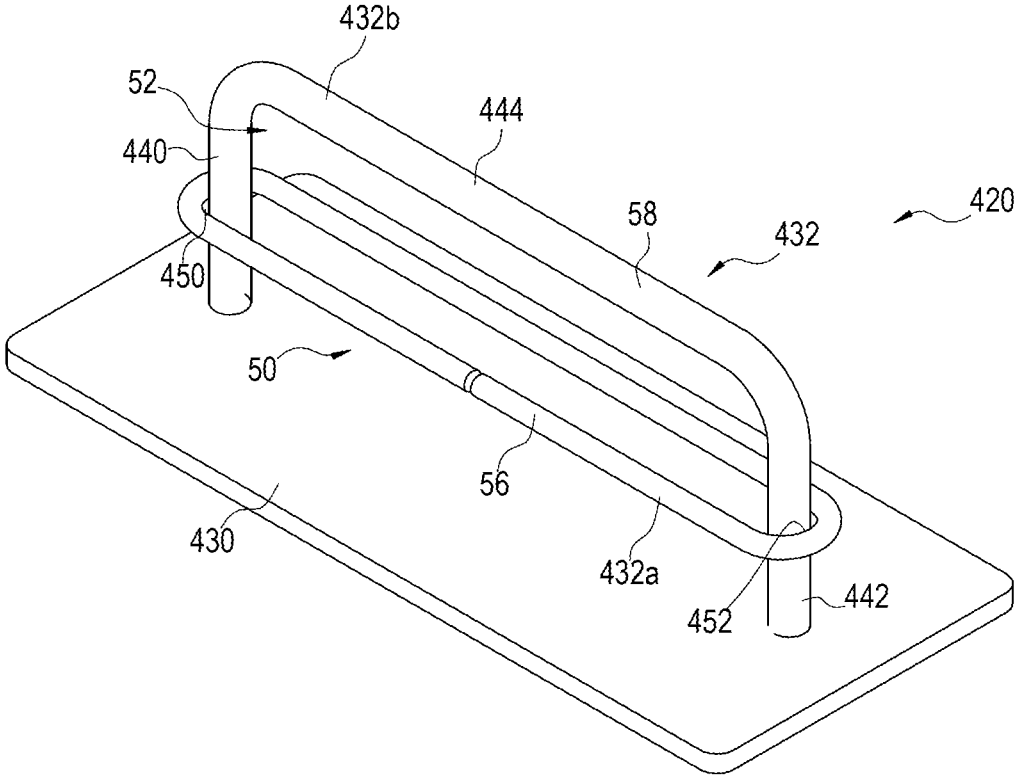
FIG. 32 is a perspective view of an eighth example wick drain shoe of the present invention.
Figure 33:
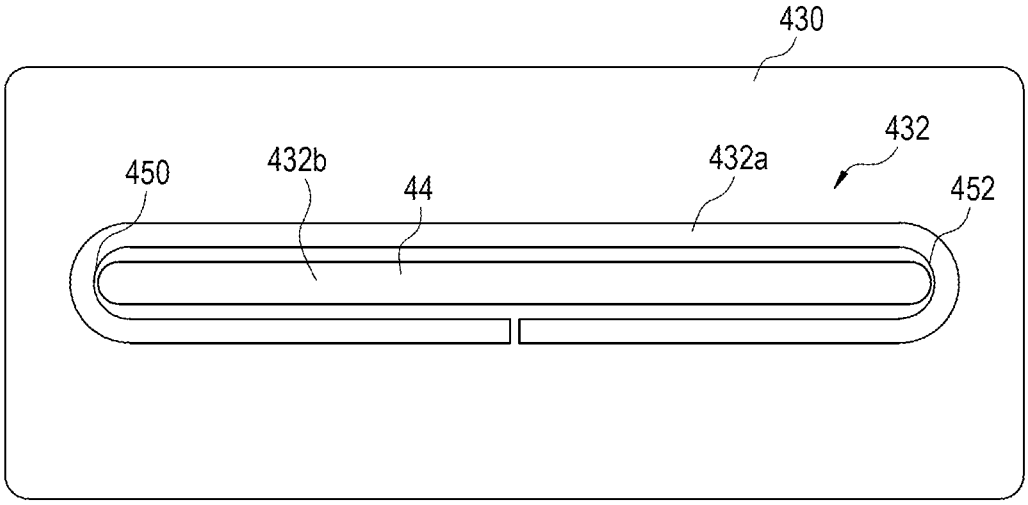
FIG. 33 is top plan view of the eighth example wick drain shoe.
Figure 34:
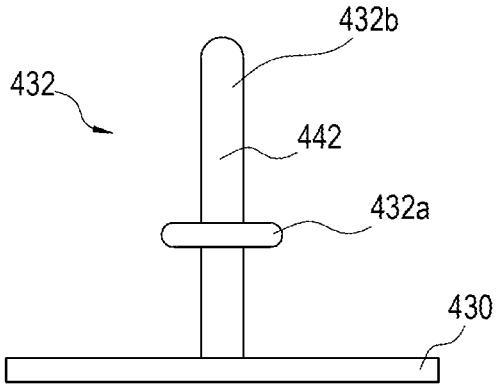
FIG. 34 is a side elevation plan view illustrating assembly of the eighth example wick drain shoe.

Referring now to FIGS. 32-34 of the drawing, depicted therein is an eighth example wick drain shoe 420 constructed in accordance with, and embodying, the principles of the present invention. The eighth example wick drain shoe 420 comprises a base portion 430 and an extension structure 432 comprising a cross portion 432*a*—and an extension portion 432*b*. The example cross portion 432*a* is a plate, plate, rod, tube, or bar, and the example extension portion 432*b* is a plate, rod, tube, or bar that is formed in a generally U-shaped configuration to define first and second leg portions 440 and 442 and a closed end portion 444. The example extension portion 432*b* may be secured to the example base portion 430 by welding as generally described above with reference to the first example wick drain shoe 20 or by connecting bolts as described above with reference to the third example drain shoe 150. The example extension portion 432*b* may be integrally formed with the example base portion 430 as described above with reference to the second example wick drain shoe 120.

The example cross portion 432*a* defines first and second inner end surfaces 450 and 452. More specifically, the example cross portion 432*a* is an elongate bar configured such that the first and second inner end surfaces 450 and 452 are integrally formed on each end the bar. In the example cross portion 432*a*, a shortest distance between portions of the cross portion 432*a* defining the first and second inner end surfaces 450 and 452 is greater than a shortest distance between outer surfaces of the first and second leg portions 440 and 442 of the U defined by the extension portion 432*b*. Accordingly, the cross portion 432*a* is sized and dimensioned to be arranged relative to the extension portion 432*b* in an assembled configuration in which at least a portion of the extension portion 432*b* is received between the first and second inner end surfaces 450 and 452 as shown in FIGS. 32-34. However, the cross portion 432*a* may be removed from the extension portion 432*b* by displacing the cross portion 432*a* away from the base portion 430. When arranged in the assembled configuration, the cross portion 432*a* can move up and down along the extension portion 432*b* relative to the base portion 430; however, the first and second inner end surfaces 450 and 452 engage the first and second leg portions 440 and 442 to inhibit movement forward or back relative to the extension portion 432*b*.

The example cross portion 432*a* defines the anchor portion 56, and the first shoe opening 50 is defined between the cross portion 432*a* and the base portion 430. The example extension portion 432*b* defines the bearing portion 58. The second shoe opening 52 is defined between the cross portion 432*a* and the extension portion 432*b*.

The fourth example wick drain shoe 420 is connected to the wick drain material 24 and may be driven by the example wick drain insertion system 22 in generally the same manner as the example wick drain shoes 20, 120, 150, 220, 250, 320, and 350 described above. However, when the wick drain material 24 is under tension, the wick drain material 24 will pull the cross portion 432*a* up towards the closed end portion 444 of the extension portion 432*b* to enhance clamping or pinching forces on at least the portion of the wick drain material 24 arranged between the cross portion 432*a* and the extension portion 432*b*.

IX. Alternative Drive Systems and Wick Drain Insertion Systems

The example drive system 32 is configured to drive the mandrel 34 into the ground 26 at the desired location 28 using one or more of crowding and vibratory forces. If vibratory forces are used, the example suspension system 36 may be used to inhibit transmission of vibratory forces from the drive system 32 to the support system 30. In addition, wick drain insertion systems other than the example wick drain insertion system 22 described herein may be used with any one or more of the example wick drain shoes 20, 120, 150, 220, 250, 320, 350, and 420 described above.

What is claimed is:

1. A wick drain shoe adapted to be connected to a free end of a length of wick drain material and driven by a mandrel of a wick drain insertion system, the wick drain shoe comprising:

a base portion defining first and second connection openings, and first and second base surfaces; and an extension plate defining first and second shoe openings, and first and second connection projections; wherein the extension plate is arranged on the first base surface such that the first and second connection projections are arranged at least partly on the first base surface and at least partly within the first and second connection openings;

each connection projection is welded to the base portion such that the extension plate is secured to the base portion, an anchor portion, and a bearing portion;

the wick drain shoe is adapted to be connected to the wick drain material by inserting the free end through the first and second shoe openings such that the anchor portion and bearing portion engage the wick drain material when the wick drain material is under tension; and the first surface of the base portion is sized and dimensioned to engage the mandrel such that displacement of the mandrel in a first direction causes displacement of the wick drain shoe in the first direction.

2. The wick drain shoe of claim 1, wherein the wick drain shoe is adapted to be engaged with the wick drain insertion system to insert the wick drain material into a ground location.

3. The wick drain shoe of claim 2, wherein the wick drain insertion system comprises a support system, a drive system, the mandrel, and a suspension system.

4. The wick drain shoe of claim 3, wherein the drive system is supported by the support system such that the drive system is arranged above the ground location.

5. The wick drain shoe of claim 4, wherein the drive system is configured to drive the mandrel into the ground location.

6. The wick drain shoe of claim 5, wherein the wick drain shoe is configured such that raising the mandrel during use of the wick drain system leaves the wick drain shoe and the free end of the wick drain material secured to the wick drain shoe within the ground location.

7. The wick drain shoe of claim 1, wherein the base portion defines a base perimeter edge.

* * * * *